US007310491B2

(12) United States Patent
Pawlik et al.

(10) Patent No.: US 7,310,491 B2
(45) Date of Patent: Dec. 18, 2007

(54) NON-GOUGING SHEET STRIPPER ASSEMBLY

(75) Inventors: Robert S. Pawlik, Webster, NY (US); Robert R. Tuchrelo, Williamson, NY (US); Billy T. Stojanovski, Webster, NY (US); Nathan E. Smith, Hamlin, NY (US)

(73) Assignee: Xerox Corporation, Norwalk, CT (US)

( * ) Notice: Subject to any disclaimer, the term of this patent is extended or adjusted under 35 U.S.C. 154(b) by 151 days.

(21) Appl. No.: 11/234,454

(22) Filed: Sep. 23, 2005

(65) Prior Publication Data

US 2007/0071512 A1 Mar. 29, 2007

(51) Int. Cl.
*G03G 15/20* (2006.01)

(52) U.S. Cl. ..... 399/323; 271/900

(58) Field of Classification Search ..... 399/323, 399/322, 398, 399; 271/900
See application file for complete search history.

(56) References Cited

U.S. PATENT DOCUMENTS 4,929,983 A 5/1990 Barton et al.
5,160,130 A 11/1992 Fromm et al.
5,589,925 A * 12/1996 Cahill ..... 399/323
6,490,428 B1 * 12/2002 Fromm et al. ..... 399/323
6,678,496 B1 * 1/2004 Aslam et al. ..... 399/323
6,785,503 B2 8/2004 Kuo et al.
6,963,717 B1 * 11/2005 Klimley et al. ..... 399/323
2005/0013638 A1 * 1/2005 Fukuda et al. ..... 399/323
2005/0084302 A1 * 4/2005 Masuda et al. ..... 399/322

* cited by examiner

*Primary Examiner*—Sophia S. Chen
(74) *Attorney, Agent, or Firm*—Tallam I. Nguti

(57) ABSTRACT

A non-gouging sheet stripper assembly is disclosed for stripping copy sheets from a surface of a moving fusing member. The non-gouging sheet stripper assembly includes (a) at least one baffle forming part of a sheet path; (b) a finger shaft having a first end attached to the at least one baffle and a second distal end for forming a sheet directing first angle with the surface of the moving fusing member; and (c) a finger tip located at the second distal end of the finger shaft and having a contour for forming a sheet stripping second angle, that is different from the sheet directing first angle with the surface of the moving fusing member.

15 Claims, 3 Drawing Sheets

NON-GOUGING SHEET STRIPPER ASSEMBLY

The present invention relates to electrostatographic reproduction machines, and in particular to such a machine including a fuser assembly having a non-gouging sheet stripper assembly for stripping copy sheets from the fuser assembly.

In electrostatographic reproduction machines commonly in use today, a charge-retentive member is charged to a uniform potential and thereafter exposed to a light image of an original document to be reproduced. The exposure discharges the charge-retentive surface in exposed or background areas and creates an electrostatic latent image on the member that corresponds to the image areas contained within the original document.

Subsequently, the electrostatic latent image on the charge-retentive surface is made visible by developing the image with developing powder referred to in the art as toner. Most development systems employ a developer material that comprises both charged carrier particles and charged toner particles that triboelectrically adhere to the carrier particles. During development the toner particles are attracted from the carrier particles by the charge pattern of the image areas on the charge-retentive area to form a powder image on the photoconductive area. This image is subsequently transferred to a support surface, such as copy paper, to that it is permanently affixed by heating or by the application of pressure at a fusing apparatus. Following transfer of the toner image to a support surface, the charge-retentive member is cleaned of any residual toner that may remain thereon in preparation for the next imaging cycle.

One approach to fixing, or "fusing," the toner image is applying heat and pressure by passing the copy sheet carrying the unfused toner image between a pair of opposed roller members of a fusing apparatus, at least one of the rollers is internally heated. During this procedure, the temperature of the toner material is elevated to a temperature at that the toner material coalesces and becomes tacky. This heating causes the toner to flow to some extent into the fibers or pores of the sheet. Thereafter, as the toner material cools, solidification of the toner material causes the toner material to become bonded to the sheet.

After the fusing step, the sheet carrying the fused image is stripped from the fusing member and then fed to a subsequent processing station, such as an inverter, collator, stapler, or booklet maker. Prior art stripper finger assemblies typically involve solid rigid fingers that either slide away from the fuser surface or include expensive articulating assemblies for attempting to achieve similar results. Examples of fusing apparatus including such prior art stripper finger assemblies are disclosed in the following references. U.S. Pat. No. 4,929,983 issued May 29, 1990 and entitled "Stripper mechanism" discloses a stripper for separating a print substrate from a fusing member in an electrostatographic printing machine has a substantially flat, thin, resiliently flexible finger-like member having a raised dimple-like bump adjacent one end of the finger-like member for contacting the print substrate when stripped from the fusing member, the finger-like member being coated on both sides with a smooth low surface energy film.

U.S. Pat. No. 5,160,130 issued Nov. 3, 1992 and entitled "Thin-tip stripper finger for use with a fuser roll in an electrostatographic apparatus" discloses a stripper finger separates a substrate from a fusing member in an electrostatographic reproduction machines. The stripper finger is a member defining an edge in the form of a symmetrical convex arc across the width of the member. The thickness of the member decreases from a chord through the convex arc perpendicular to the axis of symmetry of the arc, to the edge.

U.S. Pat. No. 6,785,503 issued Aug. 31, 2004 and entitled "Stripper fingers and roller assembly for a fuser in a electrostatographic reproduction machines" discloses stripper fingers that remove the print sheet from a fuser roll in a fuser for xerographic printing. The stripper finger having a tip for stripping a lead edge of a sheet from the fuser roll. A roller assembly, positioned adjacent to the stripper finger; for engaging the lead edge of a sheet and lifting the sheet from further contact with the tip after the tip of the stripper finger strips the lead edge of the sheet from the fuser roll. The roller assembly is removably mounted by using a snap-on mounting structure.

Unfortunately, conventional stripper fingers such as those disclosed herein have a tendency to gouge the surface of the fusing member particularly during an accordion-type jam of a copy coming from the fuser assembly nip. Such gouging undesirably results in subsequent fused images having portions with gloss differentials and marks, and in premature fusing member wear.

In accordance with the present disclosure, there has been provided a non-gouging sheet stripper assembly for stripping copy sheets from a surface of a moving fusing member. The non-gouging sheet stripper assembly includes (a) at least one baffle forming part of a sheet path; (b) a flexible finger shaft having a first end attached to the at least one baffle and a second distal end for forming a sheet directing first angle with the surface of the moving fusing member; and (c) a finger tip located at the second distal end of the finger shaft and having a contour for forming a sheet stripping second angle, that is different from the sheet directing first angle with the surface of the moving fusing member.

DETAILED DESCRIPTION

Figure 1:
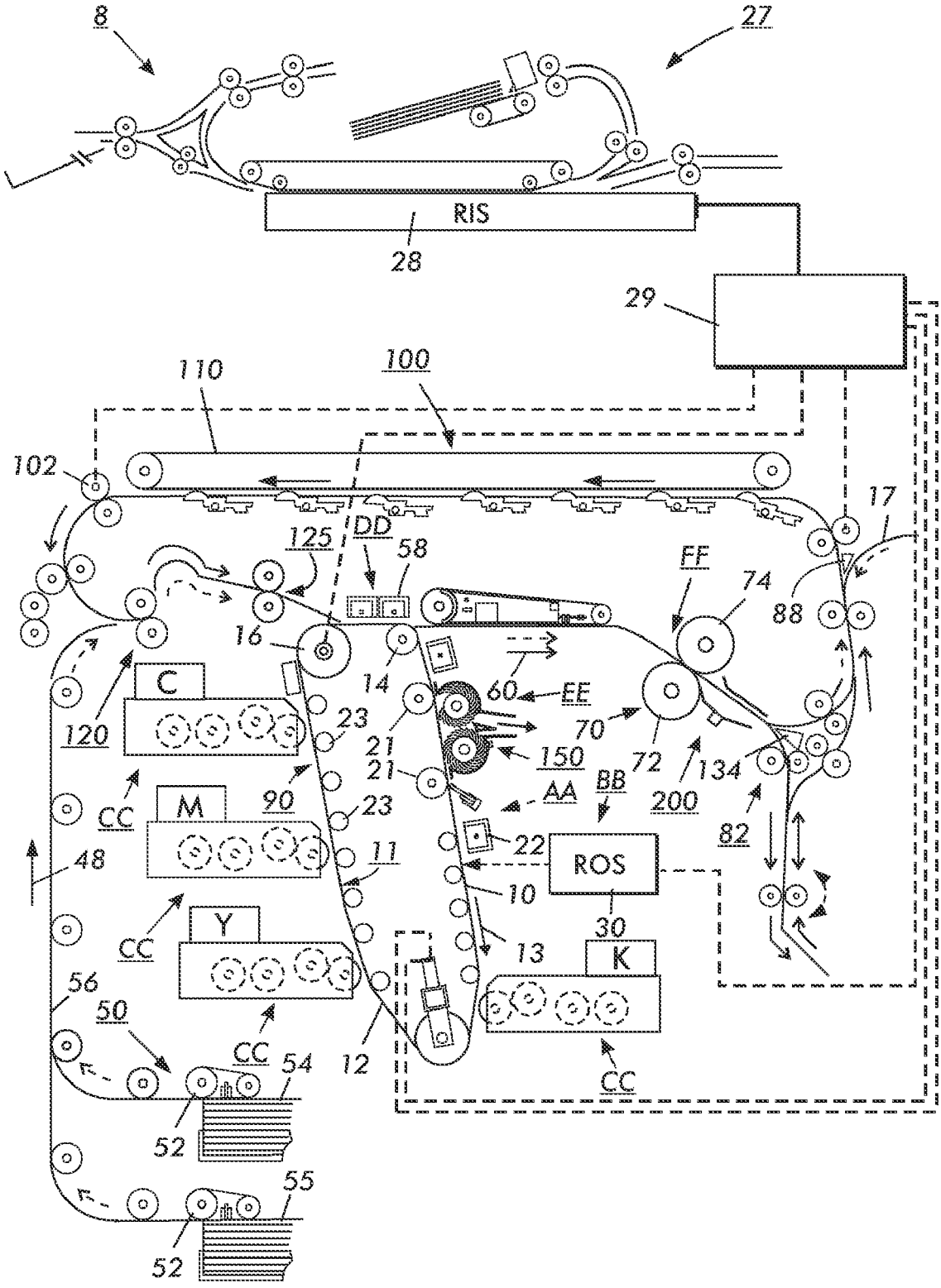
FIG. 1 is a schematic elevational view of an exemplary electrostatographic reproduction machine including a fuser assembly and the non-gouging sheet stripper assembly of the present disclosure.

Referring first to FIG. 1, it schematically illustrates an electrostatographic reproduction machine 8 that generally employs a photoconductive belt 10 mounted on a belt support module 90. Preferably, the photoconductive belt 10 is made from a photoconductive material coated on a conductive grounding layer that, in turn, is coated on an anti-curl backing layer. Belt 10 moves in the direction of arrow 13 to advance successive portions sequentially through various processing stations disposed about the path of movement thereof. Belt 10 is entrained as a closed loop 11 about stripping roll 14, drive roll 16, idler roll 21, and backer rolls 23.

Initially, a portion of the photoconductive belt surface passes through charging station AA. At charging station AA, a corona-generating device indicated generally by the reference numeral 22 charges the photoconductive belt 10 to a relatively high, substantially uniform potential.

As also shown the reproduction machine 8 includes a controller or electronic control subsystem (ESS) 29 that is preferably a self-contained, dedicated minicomputer having a central processor unit (CPU), electronic storage, and a display or user interface (UI). The ESS 29, with the help of sensors and connections, can read, capture, prepare and process image data and machine status information.

Still referring to FIG. 1, at an exposure station BB, the controller or electronic subsystem (ESS), 29, receives the image signals from RIS 28 representing the desired output image and processes these signals to convert them to a continuous tone or gray scale rendition of the image that is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. At exposure station BB, the ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image through development stations CC, that include four developer units as shown, containing CMYK color toners, in the form of dry particles. At each developer unit the toner particles are appropriately attracted electrostatically to the latent image using commonly known techniques.

With continued reference to FIG. 1, after the electrostatic latent image is developed, the toner powder image present on belt 10 advances to transfer station DD. A print sheet 48 is advanced to the transfer station DD, by a sheet feeding apparatus 50. Sheet-feeding apparatus 50 may include a corrugated vacuum feeder (TCVF) assembly 52 for contacting the uppermost sheet of stack 54, 55. TCVF 52 acquires each top sheet 48 and advances it to vertical transport 56. Vertical transport 56 directs the advancing sheet 48 through feed rolls 120 into registration transport 125, then into image transfer station DD to receive an image from photoreceptor belt 10 in a timed. Transfer station DD typically includes a corona-generating device 58 that sprays ions onto the backside of sheet 48. This assists in attracting the toner powder image from photoconductive surface 12 to sheet 48. After transfer, sheet 48 continues to move in the direction of arrow 60 where it is picked up by a pre-fuser transport assembly and forwarded to fusing station FF.

Fusing station FF includes a fuser assembly of the present disclosure that is indicated generally by the reference numeral 70 for fusing and permanently affixing the transferred toner powder image 213 to the copy sheet 204. Preferably, fuser assembly 70 includes a heated fuser roller 72 and a pressure roller 74 with the powder image 213 on the copy sheet 204 contacting fuser roller 72. The pressure roller 74 is loaded against the fuser roller 72 forming a fusing nip 75 for providing the necessary pressure to fix the heated toner powder image 213 to the copy sheet. The fuser roll 72 for example is internally heated by a quartz lamp 76. The fuser roll surface may be cleaned by a roll 77, and release agent, stored in a reservoir (not shown), may be pumped to a metering roll 79 for application to the surface of the fuser roll after the sheet is stripped by the non-gouging stripper finger assembly 200 into sheet path 202 in accordance with the present disclosure (to be described in detail below) from such surface.

After that, the sheet 204 then passes to a gate 88 that either allows the sheet to move directly via output 17 to a finisher or stacker, or deflects the sheet into the duplex path 100. Specifically, the sheet (when to be directed into the duplex path 100), is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station DD and fuser 70 for receiving and permanently fixing the side two image to the backside of that duplex sheet, before it exits via exit path 17.

After the print sheet is separated from photoconductive surface 12 of belt 10, the residual toner/developer and paper fiber particles still on and may be adhering to photoconductive surface 12 are then removed therefrom by a cleaning apparatus 150 at cleaning station EE.

Figure 4:
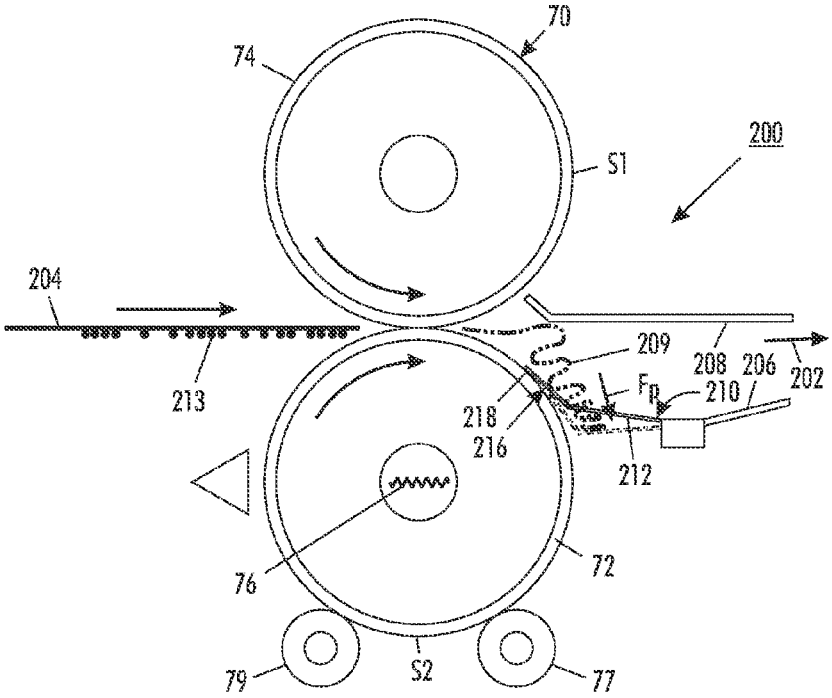
FIG. 4 is an enlarged end section schematic of the fuser assembly of FIG. 1 showing the first embodiment of the non-gouging stripper finger assembly of FIG. 2, in the case of a jam, flexing in accordance with the present disclosure.
Figure 5:
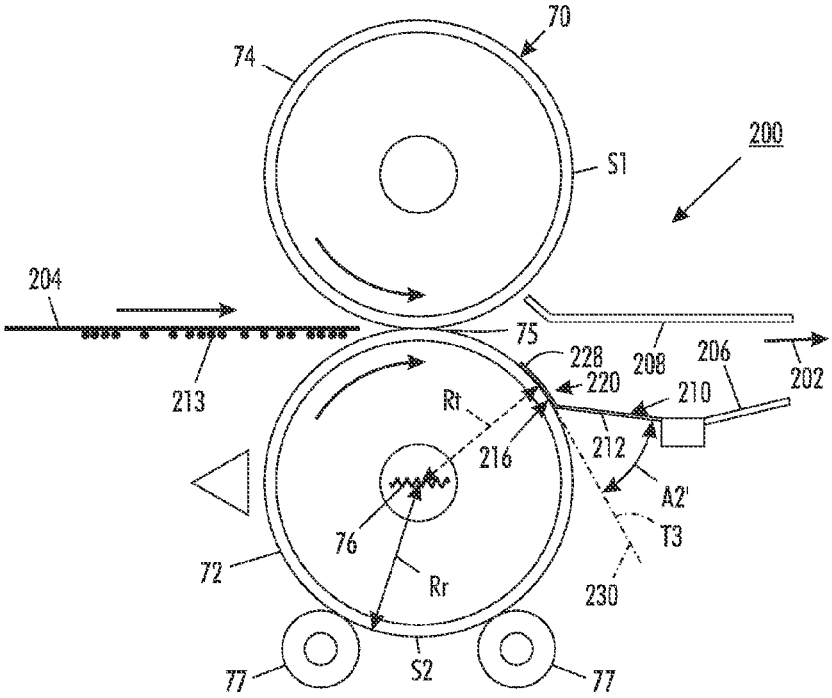
FIG. 5 is an enlarged end section schematic of the fuser assembly of FIG. 1 showing a second embodiment of the non-gouging stripper finger assembly of the present disclosure.

Referring in particular to FIG. 4, and as is well known in the art, a problem can occur if the subsequent processing station following the sheet path 202 malfunctions and is thus unable to accept the copy sheet 204 exiting the fusing nip 75. Because the sheet 204 is nonetheless still being pushed forwardly by the motion of fusing rolls 72, 74, the sheet will jam and be compacted between surfaces formed by baffles 206 and 208. The funnel-like surfaces of the baffles 206, 208 will tend to exacerbate such a jamming problem, resulting in a very compact accordion-folding jam 209 of the sheet 204, producing a jam force Fp pushing down on the shaft 212 of the stripper finger 210. Ordinarily this would result in a tip of the stripper finger forming a common or one sheet stripping and sheet directing angle with the surface of the fuser roll, and such finger being pressed into and gouging the surface of the fuser roll 72. Conventionally, the attempts to avoid this involve expensive finger sliding or finger articulating mechanisms.

Referring now to FIGS. 1-5, the toner fuser assembly 70 of the present disclosure can be seen to (a) the movable pressure fusing member or pressure roller 74 having a first outer surface S1; (b) the movable heated fusing member or fuser roller 72 having a second outer surface S2 forming a fusing nip 75 with the first outer surface S1 for receiving, heating and fusing copy sheets 204 carrying toner images 213; and (c) a non-gouging sheet stripper assembly 200 for stripping the copy sheets 204 from the movable heated fusing member 72.

As further shown, the non-gouging sheet stripper assembly 200 includes (i) at least one baffle 206 (the lower baffle as shown) forming part of a sheet path 202 downstream from the fusing nip 75; (ii) a flexible finger shaft 212 made of a resilient spring material and having a first end 214 attached to the at least one baffle 206 and a second distal end 216 for forming a sheet directing first angle A1 with a tangent T1 to the second surface S2 of movable fusing member 72; and (iii) a finger tip 218 located at the second distal end 216 of the flexible finger shaft 212. In accordance with an aspect of the present disclosure, the finger tip 218 includes a contoured portion 220 for forming a sheet stripping second angle A2 that is different from the sheet directing first angle Al, with a tangent T2 to the second surface S2 of movable fusing member 72.

Figure 2:
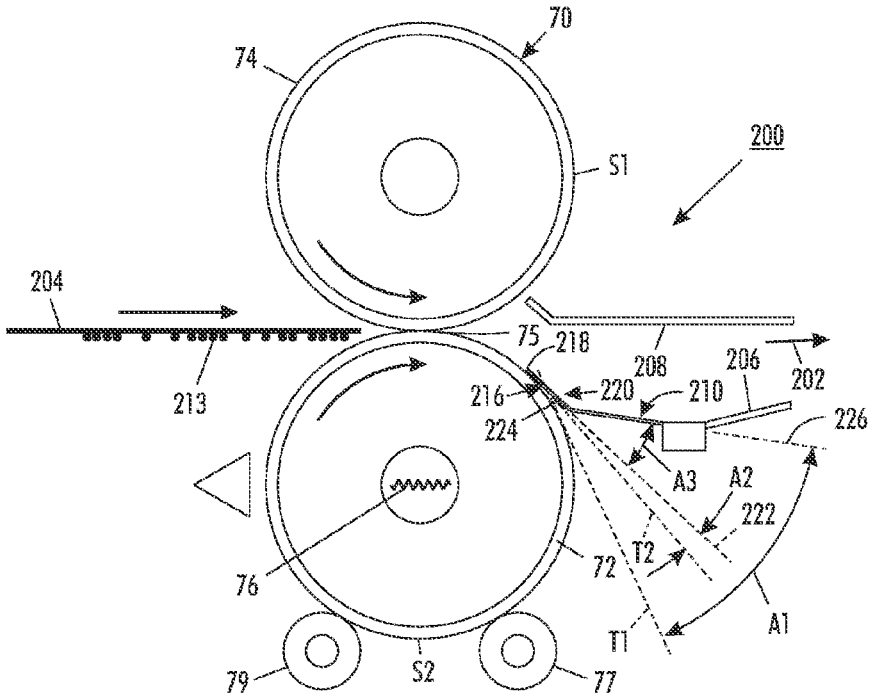
FIGS. 2-3 are each an enlarged end section schematic of the fuser assembly of FIG. 1 showing a first embodiment of the non-gouging stripper finger assembly of the present disclosure.
Figure 3:
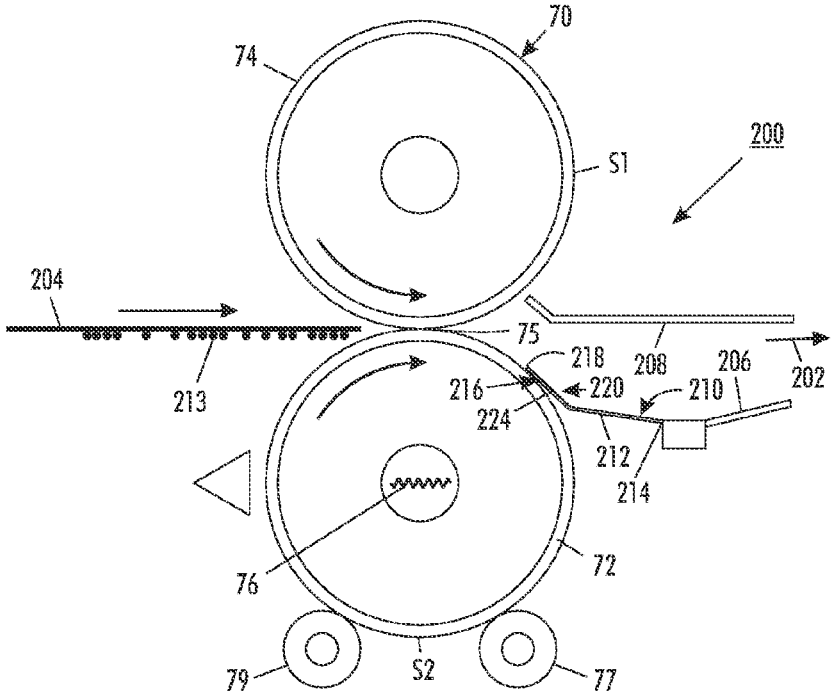

In FIGS. 2 and 4, the sheet stripping second angle A2 is shown as defined by the tangent T2 and an axis 222 through the finger tip 218 of the flexible finger shaft 212. As shown, the sheet stripping second angle A2 is less than the sheet directing first angle A1. In a first embodiment as shown in FIGS. 2-3, the contoured portion 220 is comprised of a straight finger portion 224 forming a third angle A3 with an axis 226 of the finger shaft 212. The straight portion 224 is also spaced from, and forms the sheet stripping angle A2 with, the tangent T2 at the surface S2. The sheet stripping second angle A2 as such is greater than zero degrees but less than the sheet directing angle A1.

In a second embodiment, the contoured portion 220 can comprise a curved portion 228 that is connected to the flexible finger shaft 212 and that has a radius of curvature Rt that is equal to or slightly greater than the radius Rr of the surface S2 of the fusing member 72. As such, the curved portion 228 will have an axis 230 that is coincident with a tangent T3 to the surface S2 at a point of contact. Accordingly an equivalent sheet stripping second angle A2' will be zero degrees, which is significantly less than the sheet directing angle A1.

In the machine 8, the non-gouging sheet stripper assembly 200 includes a plural number of the finger shaft 212 aligned from one end to the other of the fuser roll 72 as is well known in the art, and a corresponding plural number of finger tips 218. Again, the flexible finger shaft 212 can be a thin blade-like member that is resiliently bendable between the first end 214 and the distal end 216 thereof by a force Fp of a sheet jam 209 within the sheet path 202. Accordingly, the flexible finger shaft 212 can be made of a spring material such as coated spring steel. The sheet stripping second angle or bend A2 at the tip 218 of the flexible blade-like stripper finger 210 is for decreasing the attack angle with a tangent to the surface S2 of the fuser roll. The net result during an accordion jam as illustrated in FIG. 2 is a re-distribution of the jam forces, and a decrease in pressure on the fuser roll surface. The decreased attack angle also increases the surface contact between the tip 218 of the finger 210 and the surface S2 of the fuser roll, and has been found to easily alter the stripper finger geometry during a jam such that under large a deflection (for example due to an accordion jam) the tip 218 of the stripper finger 210 is actually moved away from the surface S2 of fuser roll 72, thus preventing any gouging of such surface.

As can be seen there has been provided a non-gouging sheet stripper assembly for stripping copy sheets from a surface of a moving fusing member. The non-gouging sheet stripper assembly includes (a) at least one baffle forming part of a sheet path; (b) a flexible finger shaft having a first end attached to the at least one baffle and a second distal end for forming a sheet directing first angle with the surface of the moving fusing member; and (c) a finger tip located at the second distal end of the finger shaft and having a contour for forming a sheet stripping second angle, that is different from the sheet directing first angle with the surface of the moving fusing member.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A non-gouging sheet stripper assembly for stripping copy sheets from a surface of a moving fusing member, the non-gouging sheet stripper assembly comprising:

(a) at least one baffle forming part of a sheet path;

(b) a flexible finger shaft having a first end attached to said at least one baffle and a second distal end for forming a sheet directing first angle with said surface of said moving fusing member; and (c) a finger tip located at said second distal end of said finger shaft, said finger tip including a contoured portion for forming a sheet stripping second angle with said surface of said moving fusing member, said sheet stripping second angle being different from said sheet directing first angle, and said contoured portion comprising a curved portion having a radius of curvature slightly greater than that of said surface of said moving fusing member.

2. The non-gouging sheet stripper assembly of claim 1, wherein said sheet stripping second angle is less than said sheet directing first angle.

3. The non-gouging sheet stripper assembly of claim 1, wherein said contoured portion of said finger tip comprises a straight finger portion forming a third angle with an axis of said finger shaft.

4. The non-gouging sheet stripper assembly of claim 3, wherein said straight finger portion forms a sheet stripping angle which is greater than zero degrees with a tangent to said surface of said fusing member.

5. The non-gouging sheet stripper assembly of claim 3, wherein said straight finger portion is made of a spring material.

6. The non-gouging sheet stripper assembly of claim 1, wherein said finger shaft is a thin blade-like member that is resiliently bendable between said first end and said distal end thereof by a force of a sheet jam within said sheet path.

7. The non-gouging sheet stripper assembly of claim 1, wherein said finger shaft is made of a spring material.

8. The non-gouging sheet stripper assembly of claim 7, wherein said finger shaft is comprised of coated spring steel.

9. A toner fuser assembly comprising:

(a) a movable pressure fusing member having a first outer surface;

(b) a movable heated fusing member having a second outer surface forming a fusing nip with said first outer surface of said movable pressure fusing member for receiving, heating and fusing copy sheets carrying toner images; and (c) a non-gouging sheet stripper assembly for stripping said copy sheets from said movable heated fusing member, the non-gouging sheet stripper assembly including:

(i) at least one baffle forming part of a sheet path from said fusing nip;

(ii) a flexible finger shaft having a first end attached to said baffle and a second distal end for forming a sheet directing first angle with said second surface of said movable fusing member; and (iii) a finger tip located at said second distal end of said finger shaft, said finger tip including a contoured portion for forming a sheet stripping second angle with said second surface of said movable fusing member, said sheet stripping second angle being different from said sheet directing first angle, and said contoured portion comprising a curved portion having a radius of curvature slightly greater than that of said second outer surface of said heated fusing member.

10. The toner fuser assembly of claim 9, wherein said sheet stripping second angle is less than said sheet directing first angle.

11. The toner fuser assembly of claim 9, wherein said contoured portion of said finger tip comprises a straight finger portion forming a third angle with an axis of said finger shaft.

12. The toner fuser assembly of claim 9, wherein said finger shaft is a thin blade-like member that is resiliently bendable between said first end and said distal end thereof by a force of a sheet jam within said sheet path.

13. An electrostatographic reproduction machine comprising:

(a) a moveable imaging member including an imaging surface;

(b) latent imaging means for forming a latent electrostatic toner image on said imaging surface of said moveable imaging member;

(c) a development apparatus mounted adjacent a path of movement of said moveable imaging member for developing said latent electrostatic image on said imaging surface into a toner image;

(d) a transfer station for transferring said toner image from said imaging surface onto an image-carrying substrate; and (e) a toner fuser assembly including a non-gouging sheet stripper assembly for stripping said image-carrying substrate from a movable heated fusing member, the non-gouging sheet stripper assembly including:

(i) a baffle forming part of a sheet path from a fusing nip;

(ii) a finger shaft having a first end attached to said baffle and a second distal end for forming a sheet directing first angle with a surface of said movable heated fusing member; and (iii) finger tip located at said second distal end of said finger shaft, said finger tip including a contour for forming a sheet stripping second angle with a surface of said movable heated fusing member, said sheet stripping, second angle being different from said sheet directing first angle, and said contoured portion comprising a curved portion having a radius of curvature slightly greater than that of said surface of said movable fusing member.

14. The electrostatographic reproduction machine of claim 13, wherein said sheet stripping second angle is less than said sheet directing first angle.

15. The electrostatographic reproduction machine of claim 13, wherein said contoured portion of said finger tip comprises a straight finger portion forming an angle with an axis of said finger shaft.

* * * * *